US005722277A

United States Patent [19]

Williams

[11] Patent Number: 5,722,277

[45] Date of Patent: Mar. 3, 1998

[54] KEY RING OPENER AND METHOD OF USE

[76] Inventor: James M. Williams, 425 S. Elm St., No. 15A, Arroyo Grande, Calif. 93420

[21] Appl. No.: 795,993

[22] Filed: Feb. 5, 1997

[51] Int. Cl.[6] ..... A44B 15/00

[52] U.S. Cl. ..... 70/456 R; 70/457; 70/458; 81/488

[58] Field of Search ..... 70/456 R, 457–460; 81/488; D3/207, 208, 210; 206/37.1, 37.8, 38.1; 24/3.6

[56] References Cited

U.S. PATENT DOCUMENTS

| | | | |
|---|---|---|---|
| 4,325,273 | 4/1982 | Gibbons | 81/3 R |
| 4,543,860 | 10/1985 | Van Meter | 81/488 |
| 4,706,477 | 11/1987 | Rousseau | 70/456 R |
| 4,719,778 | 1/1988 | Murphy et al. | 70/456 R |
| 4,790,161 | 12/1988 | Dick | 70/456 R |
| 5,373,717 | 12/1994 | Gore et al. | 70/456 R |

*Primary Examiner*—Lloyd A. Gall
*Attorney, Agent, or Firm*—Leo F. Costello

[57] ABSTRACT

A key ring opener for spreading apart the adjacent end and intermediate portions of a split key ring that are spring-urged against each but are spreadable to allow a key to be placed on or taken off the ring. The opener includes an annular band having sharp circumferential wedging edges and is adapted to encircle such a key ring in the same way as a key, and along with keys on the ring, and a wedging bar extending diametrically of the band and having sharp wedging edges. The opener is slipped on and off the key ring like a key but is easier to do because of the sharp circumferential edges. While on the key ring, the bar can be wedged, again because of its sharp edges, between adjacent segments of the ring, ahead of a key, thereby to spread the segments apart. Thereafter, the band is rolled between the thumb and forefinger causing the bar to leverage the segments of the key ring farther apart thereby to facilitate entry and removal of a key to and from the ring. In addition to being small and lightweight, another valuable feature is that the opener will not come off the ring while the opener is facilitating key entry and removal although it can easily be removed if desired.

18 Claims, 3 Drawing Sheets

KEY RING OPENER AND METHOD OF USE

FIELD OF THE INVENTION

The present invention pertains to a key ring opener and more particularly to a device for spreading apart the adjacent segments of a key ring that are spring-urged together thereby to, facilitate placing a key on or removing a key from the ring.

BACKGROUND

Perhaps the most common and dependable device for carrying keys is a split key ring. This device provides almost two turns of spring steel that are wound so that a pair of end segments are spring-pressed against a center segment, with the end segments terminating in ends where keys enter and leave the ring. Although keys are very securely retained by such a key ring, this very security makes moving keys on and off very difficult since the tightly wound turns of the ring must be spread apart far enough to allow passage of a key.

Typically, a user may attempt to use the head of a key itself to wedge its way between one of the ends and the center segment of the ring. Failing this, or alternatively, one may attempt to spread the ring apart by inserting a finger nail between the end and the center segment, possibly breaking the finger nail or hurting the finger. If there are many keys on the ring, or if other items such as pocket knife are carried on the ring, the bulk of keys and other items may add resistance to spreading the segments of the ring. This problem of adding and removing keys is realized by anyone who carries keys, but it is especially annoying to those who regularly use keys in their daily work, such as those who work in the maintenance and security trades.

Others have recognized the problem of opening a key ring as described above. As might be expected, the prior efforts have involved some type of device or implement for wedging and spreading the segments of the key ring apart. Each of the patented openers may serve to open a key ring, but they have common disadvantages in that they add bulk to a ring already full of keys and are not as simple to use as might be desired.

SUMMARY

A key ring opener is provided for spreading apart the adjacent end and intermediate portions of a split key ring that are spring-urged against each but are spreadable to allow a key to be placed on or taken off the ring. The opener is adapted to encircle such a key ring in the same way as a key and along with keys on the ring. The opener includes an annular band having sharp circumferential wedging edges and a wedging bar extending diametrically of the band and also having sharp wedging edges. The opener is slipped on and off the key ring like a key but is easier to do because of the sharp circumferential edges. While on the key ring, the bar can be wedged, again because of its sharp edges, between adjacent segments of the ring, ahead of a key, thereby to spread the segments apart. Thereafter, the band is rolled between the thumb and forefinger causing the bar to leverage the segments of the key ring farther apart thereby to facilitate entry and removal of a key to and from the ring. In addition to being small and lightweight, another valuable feature is that the opener will not come off the ring while the opener is facilitating key entry and removal although it can easily be removed if desired.

An object of this invention is to facilitate the spreading apart of the segments of a key ring so that keys can be added to or removed from the ring.

Another object is to provide a key ring opener that is easy to operate to spread apart the segments of a key ring while remaining on the ring.

Still another object is to enable a key ring opener that, in itself, is easy to attach to and remove from a key ring.

Yet another object is to provide a key ring opener that spreads apart the segments of a key ring and then provides a gap through which a key can pass, as the opener, followed by the key, are slid around the key ring either to be placed on the ring or to be removed from the ring.

Another object is to retain a key ring opener on a key ring while the opener is being used to provide a gap for a key to be removed.

An additional object is to provide a key ring opener that is able to leverage the segments of a key ring apart by rolling the opener between the fingers of the user's hand.

Yet another object is to provide a key ring opener that is small, compact and lightweight and can be carded on a key ring with keys and other items thereon while occupying a minimum of space on the ring.

Yet a further object is to provide key ring opener that is easy and inexpensive to manufacture.

These and other objects and advantages of the invention will become apparent upon reference to the accompanying drawings and the following detailed description.

DETAILED DESCRIPTION

Figure 1:
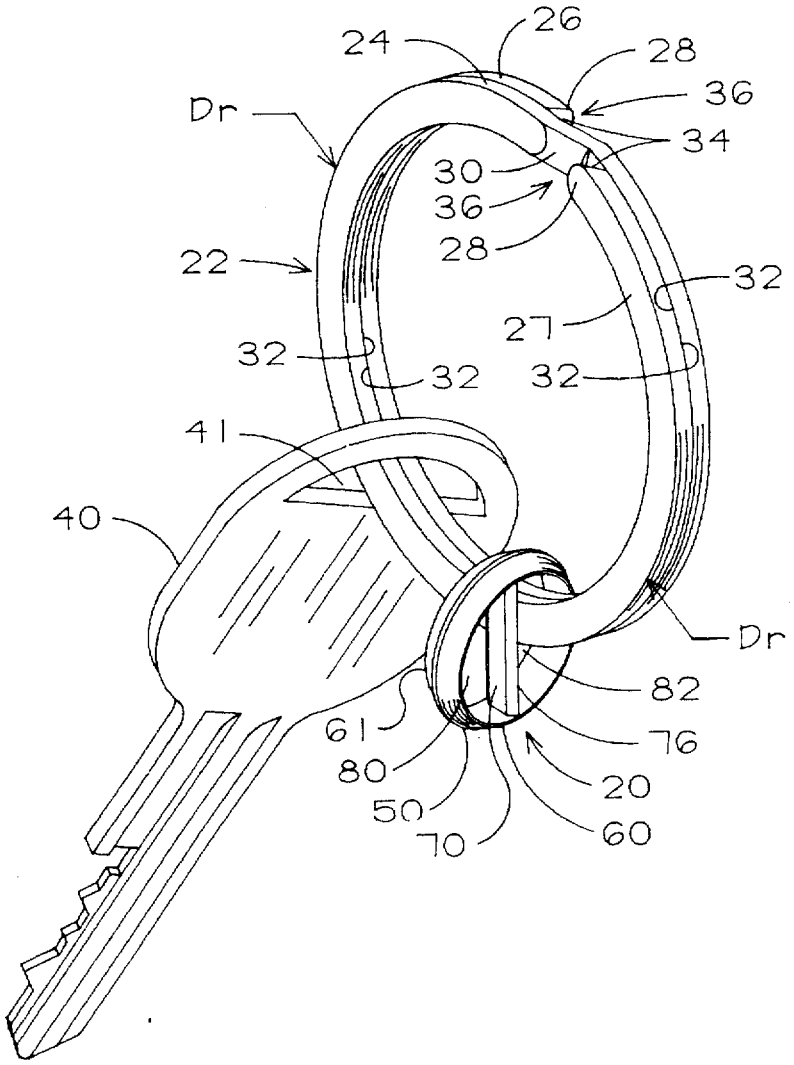
FIG. 1 is an isometric view of a key ring carrying both a key and a key ring opener constructed in accordance with the present invention, all of which are enlarged about twice their actual sizes.
Figure 2:
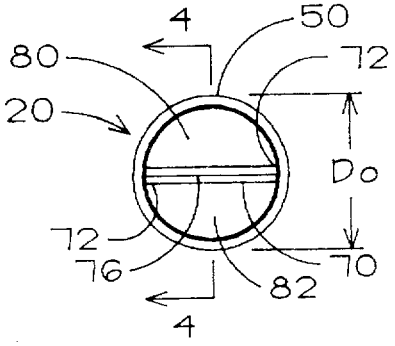
FIG. 2 is a side elevation of the key ring opener shown in FIG. 1.
Figure 3:
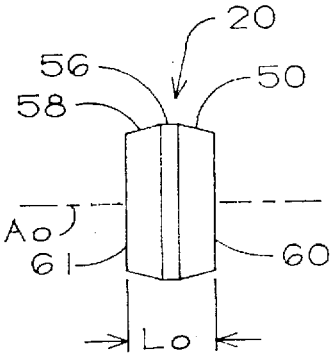
FIG. 3 is an edge view of the key ring opener of FIG. 2.

With reference to FIG. 1, a key ring opener or leveraging member in accordance with the present invention is identified by the number 20 and is shown on a key ring 22. The key ring has a diameter Dr which is typically one and one-quarter inch but may be smaller or larger depending on the number and type of keys, as 40, as well as the user's preferences, to be carried on the ring. The key ring is of typical construction being formed of spring steel, brass, or a suitable hard plastic material. This well known key ring in common use has approximately one and nine-tenths turns in the shape of a cylindrical helix or spiral.

The ring 22 (FIG. 1) is thus divided into an intermediate or center segment 24 and a pair of end segments 26 that are spring pressed into tight engagement with the intermediate segment. The end segments terminate in ends 28 that are circumferentially spaced from each other on opposite sides of the intermediate segment which has an offset segment 30 located between the ends. It is also to be observed that the intermediate and end segments have inside flat surfaces 32 that are in tight contact. Each of the ends has a ramp 34 in obtuse angular relation to its adjacent flat surface and in parallel relation to the other ramp and to the offset segment. The ramp 34 and the offset segment constitute points 36 of entry for keys, as 40, to be placed on the key ring. Furthermore, and for subsequent reference, it is noted that the key ring defines a plane which passes between the contacting flat surfaces of the ring.

The key ring opener 20 (FIGS. 1 through 4) of the present invention includes an annular band 50 which is preferably circular, thus having a diameter $D_o$ and an axis $A_o$. In the preferred embodiment of the present invention, the diameter $D_o$ is approximately ⅜ inch although a different diameter may be used, for example for larger or smaller key rings 22, without departing from the principles of the present invention. Also, the band has an axial dimension $L_o$ which, in the preferred embodiment, is approximately ¼ inch, although, again, this dimension is not critical and may be varied, as will be understood. The band is also rigid and made of steel, brass, or a suitable hard plastic, like the key ring 22.

Figure 4:
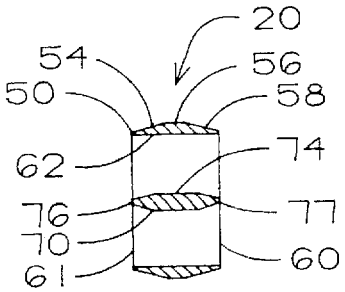
FIG. 4 is a cross section taken on line 4—4 in FIG. 2.

The band 50 (FIGS. 1 through 4) has a body 54 that provides an annular center ridge 56 and a pair of shoulders 58 which taper axially endwardly from the center ridge to then circumferential, outer wedging edges 60 and 61. The body also has a circumferential inside surface 62 which may be flat or concave, but together with the shoulders, forms the wedging edges 60 and 61 (FIG. 4).

A straight wedging bar, lever, or bridge 70 (FIGS. 1 through 4) of the same material as the band 50 has opposite ends 72 integral with the band 50 or secured thereto by welding at diametrically opposite points, and extends diametrically of the band. The bar thus has a length equal to the inside diameter of the band and a width equal to the axial dimension $L_o$ of the band. The bar has a center ridge 74 which tapers axially of the band in both directions to thin straight wedging edges 76 and 77 which likewise extend the full inside diameter of the band. The bar divides the band into a pair of semicircular halves or openings 80 and 82.

OPERATION

Figure 5:
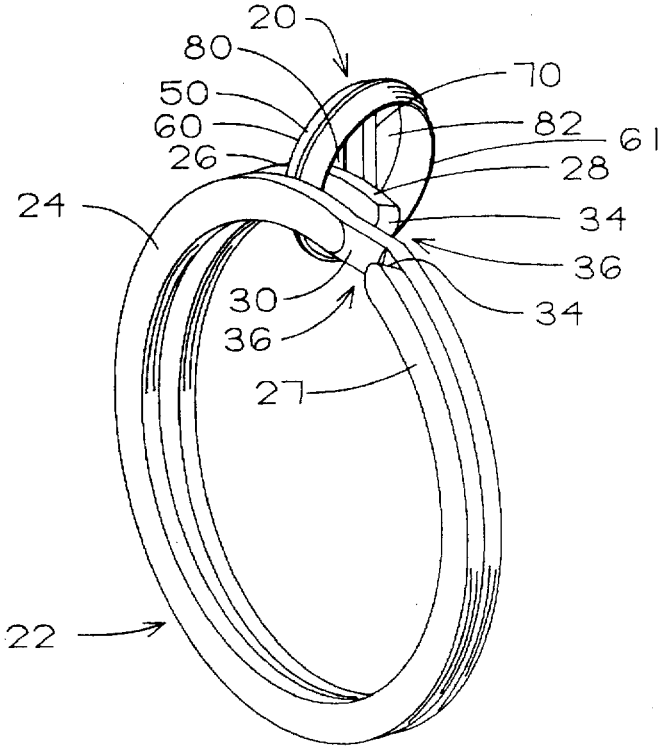
FIG. 5 is an isometric view of the subject key ring opener being shown just as the opener is being slid on, or slid off, the key ring.

The procedure for placing the key ring opener 20 on the key ring 22 and for removing it from the key ring will first be described, having reference to FIG. 5. The key ring is held in one hand with the offset segment 30 and one of the ends 28 facing the user. The key ring opener is held in the other hand and the circumferential edge 60 is slid between said one end 28 along the ramp 34 thereof and the offset segment 30 at an entry point 36 thereby to force the band 50 between the end segment 26 and the intermediate segment 24. As such, one of the semicircular openings 80 of the opener will be fitted over this end segment. The opener is then slid along between this end segment and the intermediate segment until the opener exits from the other entry point and is out from between the intermediate segment and the other end segment with the semicircular opening completely encircling the key ring (FIG. 1).

To remove the key ring opener 20 from the key ring 22, a reverse procedure is followed. Removing the key ring opener from the key ring is best understood by reference to FIG. 1, which shows the opener on the ring, and FIG. 5, which now may be thought of as showing the opener being removed from the ring. Here, however, only one-half of the band 50 is available for insertion at one of the entry points 36 since only the semicircular opening 80 (FIG. 5) circumscribes the key ring. Thus, the portion of the edge 61 defining the encircling opening 80 is slid between one of the ends 28 and the offset segment 30, and the band is slid between the end segment 27, for example, and the intermediate segment. Continued sliding of the band around the ring allows the opener to exit from the ring at the other entry point, as shown in FIG. 5.

Figure 6:
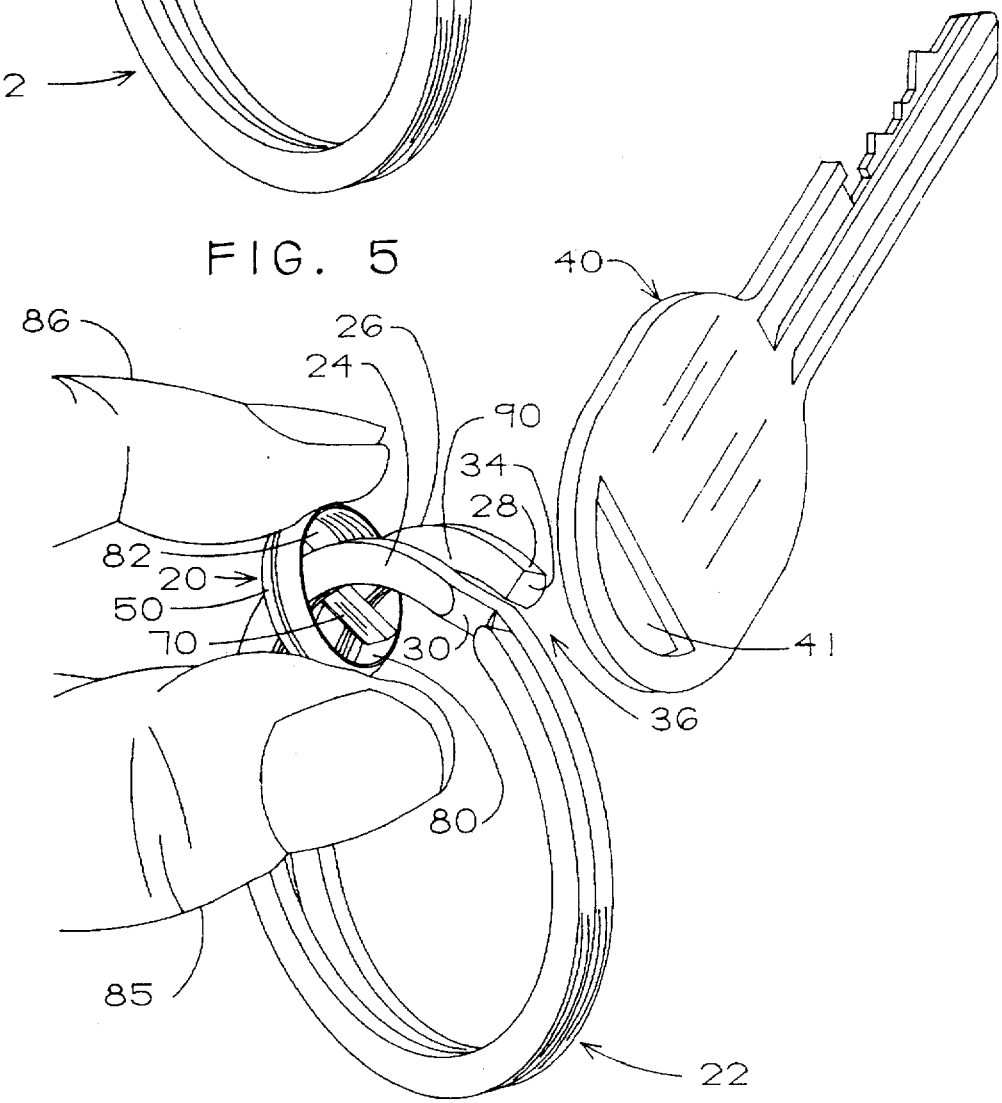
FIG. 6 is an isometric view of a key ring, a key off the ring, and the subject key ring opener on the ring and showing the opener being torqued by rolling of the opener between the thumb and forefinger of the user thereby to spread the key ring segments apart to facilitate placing the key on the ring.
Figure 7:
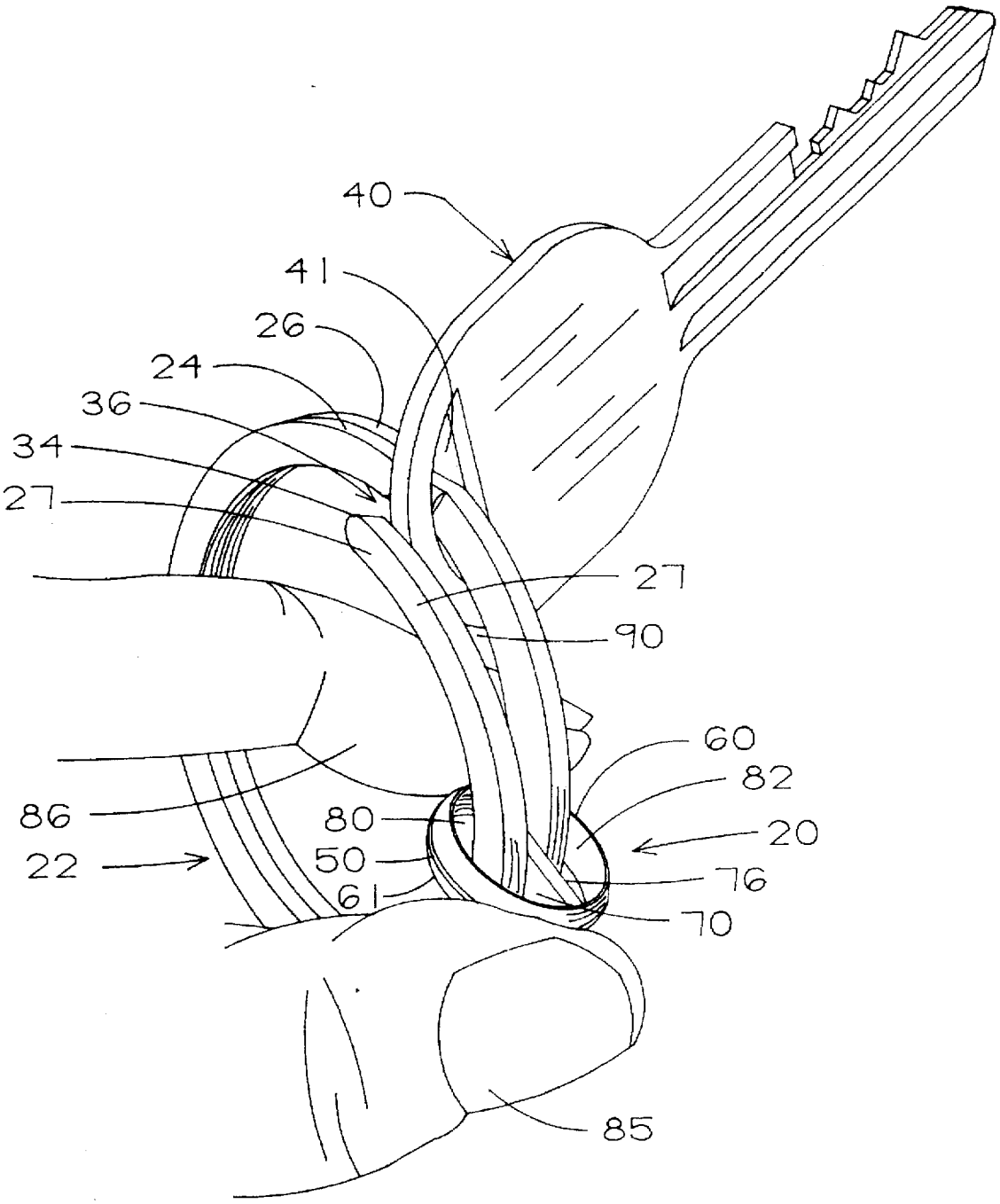
FIG. 7 is an isometric view of a key ring, and both a key and the subject key ring opener on the ring and showing the opener being torqued by the thumb and forefinger to spread the segments of the key ring apart to facilitate removing the key from the ring.

For spreading the key ring 22 to insert or remove a key, as 40, it is assumed that the key ring opener 20 is on the key ring after having been placed there as described above. For inserting a key on the key ring, the key ring opener is moved around the key ring (FIG. 1) until it is adjacent to the offset segment 30. In this position, one of the wedging edges 76 of the wedging bar 70 is slid between one of the ends 28 and the offset segment so that it moves along the ramp 34 and allows the bar to slide between the end and intermediate segments 26 and 24 (FIG. 6). This action is very simple to accomplish because the wedging edge is tapered and thin and is facilitated by the ramp, although such a ramp is not necessary for wedging entry of the bar. This initial position of the key ring opener on the key ring, prior to full spreading of the key ring, is such that the bar is in the plane of the key ring and that the end and intermediate segments are partially spread apart. FIG. 7 shows this coplanar position of the bar although FIG. 7 illustrates removal, instead of addition, of a key.

To increase the amount of spreading, however, the band 50 (FIG. 6) is grasped at diametrically opposed places on the band between the thumb 85 and the finger 86 of the user and rolled so as to cause the wedging bar 70 to tilt into an angular relationship with the plane of the key ring. Such rolling and tilting action causes the wedging bar to apply leverage between the end and intermediate segments 26 and 24 and thereby spread these two segments farther apart. As such, the spacing 90 between the end and intermediate segments allows ample room to insert the head of the key 40 and the opening 41 thereof on the end segment 26 and to move the key along the end segment. Thereafter, the key and the key ring opener are moved together, with the key following the opener, around the key ring until both the key ring opener and the key are fully on the key ring with a semicircular opening of the opener and the head of the key completely circumscribing the key ring.

To remove a key 40 from the key ring 22, the band 50 is placed adjacent to the offset segment 30, and the bar 70 is wedged between an end 28 and the offset segment 30, similar to that described above when placing a key on the ring. When the bar 70 is in the position as shown in FIG. 7, the key 40, now behind the key ring opener, is slid along the key ring until the key exits from the other entry point 36 and is thus free of the key ring. It is significant to note, however, that in the process of removing a key from the key ring, the key ring opener does not separate from the key ring. In moving around the key ring in advance of the key, the key ring opener moves from a position where one of the semicircular openings as 80 circumscribes the key ring to a position where the other semicircular opening as 82 circumscribes the key ring. As long as the bar 70 is used to spread the segments of the key ring apart, rather than the band 50, the key ring opener remains on the key ring. If it is desired to remove the key ring opener from the key ring, then, as described above, the band is used to spread apart the segments and is then slid around the key ring whereupon it will exit from one of the entry points 36.

From the foregoing, it will be understood that the key ring opener 20 is a very effective device for spreading a split key ring 22 apart for adding or removing keys 40 to and from a key ring. The key ring opener is very small and compact, and the band 50 thereof fits on a key ring along with a number of keys without adding significant bulk to the ring or unnecessarily occupying space desired for more keys. In addition, operation of the device is very simple in that after the bar 70 is wedged between the segments of the key ring, it is very easy to roll the band 50 between the fingers and thereby spread the segments further apart. An important feature of the key ring opener is that it remains securely on the key ring while it is helping a key to be removed from the ring.

Although a preferred embodiment of the present invention has been shown and described, various modifications and substitutions may be made thereto without departing from the spirit and scope of the invention. Accordingly, it is to be understood that the present invention has been described by way of illustration and not limitation.

What is claimed is:

1. A key ring opener for spreading apart the adjacent end and intermediate portions of a split key ring that are spring-urged against each but are spreadable to allow a key to be placed on or taken off the ring, comprising:

wedge means insertable between the adjacent end and intermediate portions of a split key ring so that it is sandwiched therebetween; and means connected to the wedge means and rollable between a user's fingers for causing the wedge means to be leveraged between said end and intermediate portions thereby to spread the same apart upon such rolling movement to facilitate entry of a key between the end and intermediate portions.

2. The key ring opener of claim 1, wherein the wedge means is a bar that lies in the plane of the key ring when initially inserted between said end and intermediate portions; and wherein rolling of the rollable means causes the bar to move into angular relationship with the plane of the ring.

3. A key ring opener for spreading apart the adjacent end and intermediate portions of a split key ring that are spring-urged against each but are spreadable to allow a key to be placed on the ring, comprising:

a rigid band having an axis and adapted to encircle such a key ring; and means within the band adapted to be wedged between said end and intermediate portions of such a key ring while the band is encircling the ring and to spread the end and intermediate portions apart upon rolling of the band about its axis between the fingers of a user thereby to allow a key to be placed on or removed from the ring.

4. The key ring opener of claim 3, wherein the band has a sharp circumferential edge adapted to be wedged between the end and intermediate portions of the key ring for placing the opener on and removing it from the ring.

5. The key ring opener of claim 3, wherein the band has opposite sharp circumferential edges each of which is adapted to be wedged between the end and intermediate portions of the key ring for placing the opener on and removing it from the ring.

6. The key ring opener of claim 3, wherein the means extends diametrically of the band.

7. The key ring opener of claim 3, wherein the means is a rigid bridge extending diametrically of and connected to the band.

8. The key ring opener of claim 7, wherein the bridge has opposite sharp edges each of which is adapted to be wedgingly slid between said end and intermediate portions of such a key ring.

9. A key ring opener for spreading apart adjacent end and intermediate portions of a split key ring of spring-steel or other suitable metal having almost two turns that terminate in a pair of end portions on opposite sides of an intermediate portion, said end portions being spring-urged s against the intermediate portion but each being spreadable away from the intermediate portion to allow a key to be slid between the end and intermediate portions and onto the ring, comprising:

an annular band of rigid metal circumscribing an axis thereof and having body means that allows the band to be wedged between either end portion and the adjacent intermediate portion of a key ring and slid circumferentially of the ring until the band either completely encircles the ring or is separated from the ring; and a bridge of metal extending diametrically of the band and dividing it into two semi-circular halves so that when the band is on a key ring, the ring is within one of the halves, said bridge having body means that allows the bridge to be slidingly wedged between one of the end portions and the intermediate portion of a key ring whereupon rotational movement of the band about its axis causes the bridge to spread said one end portion and the intermediate portion apart to enable a key to be placed on or removed from the ring.

10. The key ring opener of claim 9, wherein the body means of the band has a center and a pair of shoulders that are tapered outwardly from the center to thin circumferential edges whereby either of said edges can be wedged between either end portion and its adjacent intermediate portion of a key ring and slid circumferentially of the ring until the band either completely encircles the ring or is separated from the ring.

11. The key ring opener of claim 9, wherein the body means of the bridge has a center and tapers outwardly from the center to thin edges whereby either of said edges can be slidingly wedged between one of the end portions and the intermediate portion of a key ring whereupon rotational movement of the band about its axis causes the bridge to spread said one end portion and the intermediate portion apart.

12. The key ring opener of claim 9, wherein the body means of the band has a center and a pair of shoulders that are tapered outwardly from the center to thin circumferential edges whereby either of said edges can be wedged between either end portion and its adjacent intermediate portion of a key ring and slid circumferentially of the ring until the band either completely encircles the ring or is separated from the ring; and wherein the body means of the bridge has a center and tapers outwardly from the center to thin edges whereby either of said edges can be slidingly wedged between one of the end portions and the intermediate portion of a key ring whereupon rotational movement of the band about its axis causes the bridge to spread said one end portion and the intermediate portion apart.

13. A key holding apparatus, comprising:

a split key ring having portions that are spring-urged against each but are spreadable to allow a key to be placed on the ring; and a key ring opener including a rigid band having an axis and encircling the key ring and means within the band adapted to be wedged between said spreadable portions of the key ring while the band is encircling the ring and to spread the potions apart upon rolling of the band about its axis between the fingers of a user thereby to allow a key to be placed on or removed from the ring.

14. The apparatus of claim 13, wherein the means is a bridge extending diametrically of and connected to the band.

15. A key holding apparatus comprising:

a split key ring of spring-steel or other suitable metal having almost two turns that terminate in a pair of end portions on opposite sides of an intermediate portion, said end portions being is spring-urged against the intermediate portion but each being spreadable away from the intermediate portion to allow a key to be slid between the end and intermediate portions and onto the ring; and a key ring opener having an annular band of rigid metal circumscribing an axis thereof in encircling relation to the key ring, the band having body means that allows the band to be wedged between either end portion and the adjacent intermediate portion of a key ring and slid circumferentially of the ring until the band either completely encircles the ring or is separated from the ring, and a bridge of metal extending diametrically .of the band and dividing it into two semicircular halves so that when the band is on a key ring, the ring is within one of the halves, said bridge having body means that allows the bridge to be slidingly wedged between one of the end portions and the intermediate portion of the key ring whereupon rolling movement of the band between the user's thumb and forefinger causes the bridge to spread said one end portion and the intermediate portion apart to enable a key to be placed on or removed from the ring.

16. A method of spreading apart the segments of a split ring key holder, said segments being separable but being resiliently spring urged together, comprising the steps of inserting a leveraging member between the separable segments of a split ring key holder, and applying manual force to the leveraging member by rolling a surface of the leveraging member between the fingers of a user thereby to cause the member to spread the separable segments of the key holder apart.

17. The method of claim 16, wherein the manual force is applied by gasping opposed portions of the leveraging member between two fingers of a user and rolling the member between the fingers thereby to apply said force to the member.

18. The method of claim 17 wherein the leveraging member includes an annular band and a leveraging bar extending diametrically of the band, wherein the inserting step includes inserting the bar between said separable segments, and wherein the manual force is applied by grasping the band between the thumb and forefinger and rolling the band therebetween.

* * * * *